US011152015B2

(12) United States Patent
Sung et al.

(10) Patent No.: US 11,152,015 B2
(45) Date of Patent: Oct. 19, 2021

(54) METHOD AND APPARATUS FOR PROCESSING SPEECH SIGNAL ADAPTIVE TO NOISE ENVIRONMENT

(71) Applicant: Samsung Electronics Co., Ltd., Suwon-si (KR)

(72) Inventors: Ho-sang Sung, Seoul (KR); Jong-hoon Jeong, Hwaseong-si (KR); Ki-hyun Choo, Seoul (KR); Eun-mi Oh, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 98 days.

(21) Appl. No.: 16/496,935

(22) PCT Filed: Mar. 22, 2017

(86) PCT No.: PCT/KR2017/003055
§ 371 (c)(1),
(2) Date: Sep. 23, 2019

(87) PCT Pub. No.: WO2018/174310
PCT Pub. Date: Sep. 27, 2018

(65) Prior Publication Data
US 2020/0090675 A1 Mar. 19, 2020

(51) Int. Cl.
*G10L 21/0364* (2013.01)
*G10K 11/178* (2006.01)
(Continued)

(52) U.S. Cl.
CPC .... *G10L 21/0364* (2013.01); *G10K 11/17823* (2018.01); *G10K 11/17827* (2018.01);
(Continued)

(58) Field of Classification Search
CPC . G10L 21/0208; G10L 21/0364; G10L 25/84; G10L 21/02; G10L 25/78;
(Continued)

(56) References Cited

U.S. PATENT DOCUMENTS 8,515,089 B2 8/2013 Nicholson
8,538,748 B2 9/2013 Lee et al.
(Continued)

FOREIGN PATENT DOCUMENTS

EP 2533238 A1 12/2012
GB 2432766 A 5/2007
(Continued)

OTHER PUBLICATIONS

ISA/KR, International Search Report and Written Opinion of the International Searching Authority, International Application No. PCT/KR2017/003055, dated Dec. 14, 2017, 11 pages.
(Continued)

*Primary Examiner* — Yogeshkumar Patel

(57) ABSTRACT

A voice signal processing method includes acquiring a near-end noise signal and a near-end voice signal by using at least one microphone, acquiring a far-end voice signal according to an incoming call, determining a noise control parameter and a voice signal change parameter based on at least one of information about the near-end voice signal, information about the near-end noise signal, or information about the far-end voice signal, generating an anti-phase signal of the near-end noise signal based on the noise control parameter, changing the far-end voice signal to improve articulation of the far-end voice signal based on information related to at least one of the voice signal change parameter, the near-end noise signal, or the anti-phase signal, and outputting the anti-phase signal and the changed far-end voice signal.

12 Claims, 15 Drawing Sheets

(51) Int. Cl.
*G10L 25/18* (2013.01)
*G10L 25/21* (2013.01)

(52) U.S. Cl.
CPC .. *G10K 11/17873* (2018.01); *G10K 11/17885* (2018.01); *G10L 25/18* (2013.01); *G10L 25/21* (2013.01); *G10K 2210/108* (2013.01); *G10K 2210/3044* (2013.01)

(58) Field of Classification Search
CPC ..... G10L 21/0272; G10L 25/21; G10L 25/03; G10L 25/18; G10L 25/60; G10L 2021/02082; G10K 11/17823; G10K 11/17873; G10K 11/17827; G10K 11/17854; G10K 11/16; G10K 11/17885; G10K 2210/3044; G10K 2210/1081; H04R 1/1083; H04R 2499/11
See application file for complete search history.

(56) References Cited

U.S. PATENT DOCUMENTS

| | | | | |
|---|---|---|---|---|
| 8,682,657 | B2 | 3/2014 | Lim et al. | |
| 8,744,091 | B2 | 6/2014 | Chen et al. | |
| 9,058,801 | B2 | 6/2015 | Po et al. | |
| 9,099,077 | B2 | 8/2015 | Nicholson et al. | |
| 9,202,456 | B2 | 12/2015 | Lee et al. | |
| 9,379,751 | B2 | 6/2016 | Liu et al. | |
| 2010/0296668 | A1* | 11/2010 | Lee | G10K 11/17854 381/94.7 |
| 2011/0282659 | A1 | 11/2011 | Lim et al. | |
| 2014/0064507 | A1* | 3/2014 | Su | H03G 3/32 381/71.1 |
| 2014/0141724 | A1 | 5/2014 | Liu et al. | |
| 2015/0055800 | A1 | 2/2015 | Kleijn et al. | |
| 2015/0228292 | A1 | 8/2015 | Goldstein et al. | |
| 2015/0295662 | A1 | 10/2015 | Kleijn et al. | |
| 2017/0061980 | A1* | 3/2017 | Jang | G10K 11/17875 |

FOREIGN PATENT DOCUMENTS

| | | | |
|---|---|---|---|
| JP | 2008-311876 | A | 12/2008 |
| KR | 10-2013-0106887 | A | 9/2013 |
| KR | 10-2013-0114385 | A | 10/2013 |
| KR | 10-1658908 | B1 | 9/2016 |

OTHER PUBLICATIONS

Supplementary European Search Report dated Mar. 19, 2020 in connection with European Patent Application No. 17 90 1560, 8 pages.
Office Action dated May 22, 2020 in connection with Australian Patent Application No. 2017405291, 3 pages.
Notice of Non-Final Rejection dated Mar. 26, 2021 in connection with Korean Application No. 10-2019-7027830, 11 pages.

* cited by examiner

METHOD AND APPARATUS FOR PROCESSING SPEECH SIGNAL ADAPTIVE TO NOISE ENVIRONMENT

CROSS-REFERENCE TO RELATED APPLICATIONS

This application is a 371 National Stage of International Application No. PCT/KR2017/003055, filed Mar. 22, 2017, the disclosures of which are herein incorporated by reference in their entirety.

BACKGROUND

1. Field

The disclosure relates to audio and/or speech signal processing, and more particularly, to a signal processing method and apparatus for adaptively processing an audio and/or a speech signal according to a near-end or a noisy environment of the near-end.

2. Description of Related Art

When a user makes a voice call to another party using a mobile device in an environment where various background noises exit, the voice of the other party may not be heard well due to the background noises. For example, when one makes a call in a noisy place such as on the subway or on a street where cars are passing, the voice of the other party will be heard at very small level than when making a call in a quiet place without noise. As such, the most important reason for the background noise deteriorating the articulation or sound quality of voice may be a masking effect.

There are various voice processing techniques considering background noise, and may be classified particularly according to environments of a far-end and a near-end. Among them, a voice processing technique considering the far-end environment has a limit of not considering various background noisy environments of the near-end. Accordingly, there is a demand for technologies that enable efficient processing of a voice signal transmitted from a far-end device or provided by a transmitting module according to a peripheral background noise surrounding a user of a near-end device or a receiving module, considering various peripheral background noisy environments.

SUMMARY

An objective to be solved includes a signal processing method and apparatus for improving articulation and/or sound quality of a decoded signal adaptively to a receiving side or a noisy environment of a near-end, thereby improving the quality of calling, and a computer-readable recording medium.

A representative configuration of the disclosure to achieve the above objective is as follows.

According to an embodiment of the disclosure, a voice signal processing method includes acquiring a near-end noise signal and a near-end voice signal by using at least one microphone, acquiring a far-end voice signal according to an incoming call, determining a noise control parameter and a voice signal change parameter based on at least one of information about the near-end voice signal, information about the near-end noise signal, or information about the far-end voice signal, generating an anti-phase signal of the near-end noise signal based on the noise control parameter, changing the far-end voice signal to improve articulation of the far-end voice signal based on information related to at least one of the voice signal change parameter, the near-end noise signal, or the anti-phase signal, and outputting the anti-phase signal and the changed far-end voice signal.

According to another embodiment of the disclosure, the anti-phase signal may include an anti-phase signal with respect to a virtual noise signal estimated from the near-end noise signal based on at least one of a different between a position where the near-end noise signal is acquired and a position where the far-end voice signal is perceived or a difference between a time when the near-end noise signal is acquired and a time when the far-end voice signal is perceived.

According to another embodiment of the disclosure, the information about the far-end voice signal may include at least one of information about encoding of the far-end voice signal, information about a frequency band of the far-end voice signal, information about whether the far-end voice signal is being output, information about a channel through which the incoming call is received, or information about a mode of the incoming call.

According to another embodiment of the disclosure, the information about the near-end voice signal may include information about whether the near-end voice signal is in an active state.

According to another embodiment of the disclosure, the information about the near-end noise signal may include at least one of the information about the frequency band of the near-end noise signal or information about a noise type of the near-end noise signal.

According to another embodiment of the disclosure, the noise control parameter may denote at least one of whether the anti-phase signal is generated, an output power of the anti-phase signal, or a frequency band in which the anti-phase signal is generated.

According to another embodiment of the disclosure, the voice signal change parameter may denote at least one of pieces of information about whether a change of the far-end voice is applied, an output power of the changed far-end voice signal, a frequency band in which the far-end voice signal is changed, or a voice signal change method.

According to another embodiment of the disclosure, in the changing of the far-end voice signal, a difference between the acquired far-end voice signal and a far-end voice signal in an environment where the near-end noise signal and the anti-phase signal exist may be reduced for each frequency bin of a far-end voice signal spectrum.

According to another embodiment of the disclosure, the changing of the far-end voice signal may include classifying the frequency bins into an energy increase class, an energy decrease class, and an energy maintaining class based on an auditory perception model, and transferring energy of the energy decrease class of the far-end voice signal to the energy increase class.

According to another embodiment of the disclosure, the changing of the far-end voice signal may include changing the far-end voice signal based on a speaking pattern-based model.

According to another embodiment of the disclosure, the anti-phase signal may be generated based on the changed far-end voice signal of a previous frame.

According to an embodiment of the disclosure, a voice signal processing apparatus includes at least one microphone configured to acquire a near-end noise signal and a near-end voice signal, a receiver configured to acquire a far-end voice signal according to an incoming call, a controller configured to determine a noise control parameter and a voice signal change parameter based on at least one of information about the near-end voice signal, information about the near-end noise signal, or information about the far-end voice signal, a noise reducer configured to generate an anti-phase signal of the near-end noise signal based on the noise control parameter, a voice signal changer configured to change the far-end voice signal so as to improve articulation of the far-end voice signal based on information related to at least one of the voice signal change parameter, the near-end noise signal, or the anti-phase signal, and an outputter configured to output the anti-phase signal and the changed far-end voice signal.

According to an embodiment of the disclosure, provided is a non-transitory computer-readable recording medium having recorded thereon a program for executing the above-described method.

In addition, a non-transitory computer-readable recording medium having recorded thereon a program for executing other method, other system, and the method is provided to implement the disclosure.

According to the disclosure, the quality of calling may be improved adaptively to a receiving side or a noisy environment of a near-end. A near-end noise signal may be effectively removed by using a prediction noise signal, and articulation may be improved based on a psychoacoustic model or a voice signal pattern.

Furthermore, the articulation of a far-end signal may be improved by using a near-end signal in which noise is physically reduced, and the noise of a near-end signal may be reduced by using a far-end signal with improved articulation.

DETAILED DESCRIPTION

Figure 1:
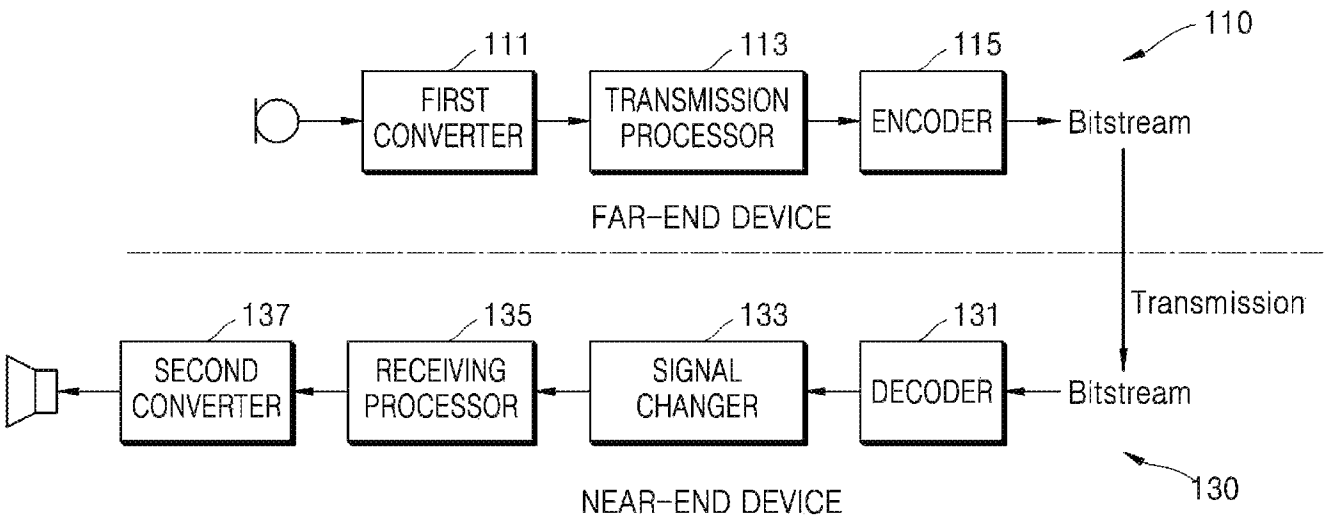
FIG. 1 is a block diagram of a configuration of a mobile communication device for a voice call, according to an embodiment.

A representative configuration of the disclosure to achieve the above objective is as follows.

According to an embodiment of the disclosure, a voice signal processing method includes acquiring a near-end noise signal and a near-end voice signal by using at least one microphone, acquiring a far-end voice signal according to an incoming call, determining a noise control parameter and a voice signal change parameter based on at least one of information about the near-end voice signal, information about the near-end noise signal, or information about the far-end voice signal, generating an anti-phase signal of the near-end noise signal based on the noise control parameter, changing the far-end voice signal to improve articulation of the far-end voice signal based on information related to at least one of the voice signal change parameter, the near-end noise signal, or the anti-phase signal, and outputting the anti-phase signal and the changed far-end voice signal.

The attached drawings for illustrating preferred embodiments of the present disclosure are referred to in order to gain a sufficient understanding of the present disclosure, the merits thereof, and the objectives accomplished by the implementation of the present disclosure. The embodiments are described in detail for a person skilled in the art to sufficiently work. Various embodiments of the disclosure are different from each other, but do not need to be contradictory to each other.

For example, a particular shape, structure, and characteristics in the present specification may be implemented by being changed from one embodiment to another embodiment without deviating from the spirit and scope of the present disclosure. Furthermore, the position and arrangement of individual constituent element in each embodiment may be understood to be modified without deviating from the spirit and scope of the present disclosure. Accordingly, the below-described detailed description may not be interpreted to be a limiting meaning, and the scope of the present disclosure may be interpreted to comprehend the scope claimed by the claims and all scopes equivalent thereto.

In the drawings, similar reference numerals denote the same or similar elements in various aspects. In the following description, when detailed descriptions about related well-known functions or structures are determined to make the gist of the present disclosure unclear, the detailed descriptions will be omitted herein, and throughout the drawings, like reference numerals denote like elements.

In the following description, embodiments are described in detail with reference to the accompanying drawings to further completely explain the present disclosure to one of ordinary skill in the art to which the present disclosure pertains. However, the present disclosure is not limited thereto and it will be understood that various changes in form and details may be made therein without departing from the spirit and scope of the following claims.

In the present specification, when a constituent element "connects" or is "connected" to another constituent element, the constituent element contacts or is connected to the other constituent element not only directly, but also electrically through at least one of other constituent elements interposed therebetween. Throughout the specification, when a portion "includes" an element, another element may be further included, rather than excluding the existence of the other element, unless otherwise described.

Hereinafter, the present disclosure will be described in detail by explaining preferred embodiments of the disclosure with reference to the attached drawings FIG. 1 is a block diagram of a configuration of a mobile communication device for a voice call, according to an embodiment.

The device illustrated in FIG. 1 may include a far-end (far-end) device 110 and a near-end (near-end) device 130, and the far-end device 110 may include a first converter 111, a transmission processor 113, and an encoder 115, and the near-end device 130 may include a decoder 131, a signal changer 133, a receiving processor 135, and a second converter 137. In the specification, the far-end device is used with the same meaning as a transmitting device, and the near-end device is used with the same meaning as a receiving device.

The far-end device 110 may include the first converter 111, the transmission processor 113, and the encoder 115, and the near-end device 130 may include the decoder 131, the signal changer 133, the receiving processor 135, and the second converter 137. Each constituent element in the far-end device 110 and/or the near-end device 130 may be implemented by being integrally with at least one processor, except a case of being implemented as separate hardware. The far-end device 110 and the near-end device 130 may be respectively installed at a transmitting side and a receiving side of each user equipment.

In FIG. 1, the first converter 111 may convert an analog signal provided through an input device, such as a microphone, to a digital signal.

The transmission processor 113 may perform various processing operations on a digital signal provided from the first converter 111. An example of the signal processing operations may include noise removal or echo reduction, but the disclosure is not limited thereto.

The encoder 115 may encode the signal provided by the transmission processor 113 by using a predetermined codec. A bitstream generated as a result of the encoding may be transmitted to a receiving side via a transmission channel or stored in a storing medium to be used for decoding.

The decoder 131 may decode a received bitstream by using a predetermined codec.

The signal changer 133 may change a decoded signal corresponding to a receiving environment, according to an environment noise signal of a near-end terminal. The signal changer 133 may change a decoded signal corresponding to a receiving environment, in response to a user input related to volume adjustment and terminal state information such as a volume level. According to an embodiment, the signal changer 133 may determine a band class related to articulation improvement with respect to each band of a noise signal and a voice signal, generate guide information for articulation improvement based on the determined band class of the noise signal and the determined band class of the voice signal, and generate a changed voice signal by applying the guide information to the voice signal. According to another embodiment, the signal changer 133 may determine a class related to articulation improvement of a voice signal with respect to each of a noise signal and the voice signal, generate guide information for articulation improvement based on the determined class and a voice articulation model modeled from a voice signal in a clean environment and a changed voice signal in a noisy environment, and generate a voice signal changed by applying guide information to the voice signal.

The receiving processor 135 may perform various signal processing operations on a signal provided from the signal changer 133. An example of the signal processing operations may include noise removal or echo reduction, but the disclosure is not limited thereto.

The second converter 37 may convert a signal provided from the receiving processor 135 to an analog signal, The analog signal provided from the second converter 137 may be reproduced through a speaker or a receiver.

An example of the codec used in FIG. 1 may include an enhanced voice service (EVS).

Figure 2:
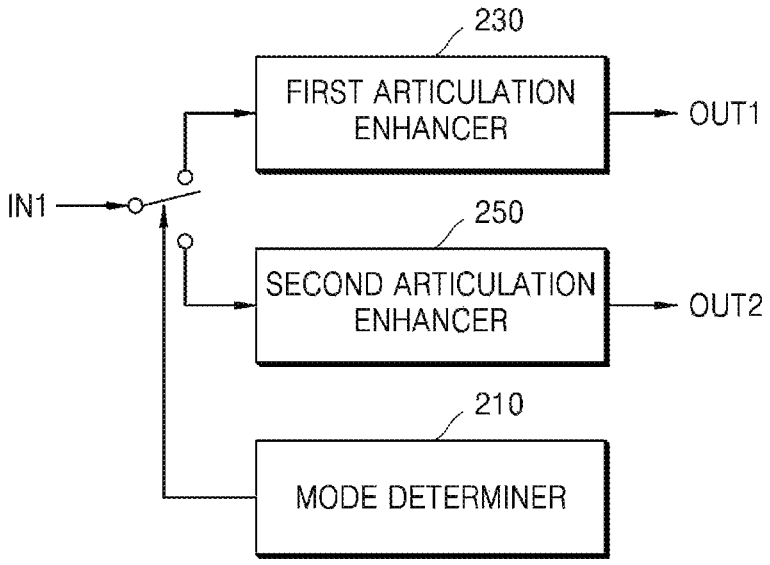
FIG. 2 is a block diagram of a configuration of a signal processing apparatus, according to an embodiment.

FIG. 2 is a block diagram of a configuration of a signal processing apparatus, according to an embodiment, which may correspond to the signal changer 133 of FIG. 1.

The device illustrated in FIG. 2 may include a mode determiner 210, a first articulation enhancer 230, and a second articulation enhancer 250. The mode determiner 210 and the second articulation enhancer 250 may be optionally provided, and thus the signal processing apparatus may he implemented by the first articulation enhancer 230.

Articulation is an index showing the quality of voice, which indicates, by a rate, how well a listener understands syllables of actual sound represented by a voice signal. Intelligibility is an index showing intelligibility regarding a meaningful word or sentence, which has a relationship in which intelligibility increases as articulation increases.

The articulation may be measured in a speech transmission index (STI) or a value of a ratio between direct sound to reflected sound (D_50). However, the above measurements are not in a relationship that is proportional to objective sound quality such as a signal-to-noise ratio and have subjective and perceptional features. Accordingly, articulation improvement corresponds to a method of improving subjective sound quality.

According to an embodiment, when a receiving volume reaches a set maximum value, the mode determiner 210 may check whether a volume-up input from a user is additionally received and determine one of a first mode and a second mode. According to another embodiment, the mode determiner 210 may determine that it is the second mode when an emergency alert broadcast is received or an emergent event such as an emergency call is detected, The first mode may be referred to as a basic mode, and the second mode may be referred to as an aggressive mode.

According to another embodiment, the mode determiner 210 may determine one of the first mode and the second mode according to an articulation improvement method that enables optical performance based on the feature of near-end noise. For example, in a noisy environment, the articulation improvement method may be set to be in the second mode by changing a voice signal such that each syllable may be clearly output. The first mode may be referred to as a basic mode, and the second mode may be referred to as a clear mode.

According to an embodiment, the first mode may be set to a default.

The first articulation enhancer 230 may operate when the mode determiner 210 determines that it is the first mode, and the second articulation enhancer 250 may operate when the mode determiner 210 determines that it is the second mode. A band class related to articulation improvement may be determined with respect to each band of a noise signal and a voice signal, guide information for the articulation improvement may be generated based on the determined band class of each of the noise signal and the voice signal, and the voice signal which is changed by applying the guide information to the voice signal may be generated. In this state, signal processing may be performed to preserve the overall energy of a frame.

Figure 3:
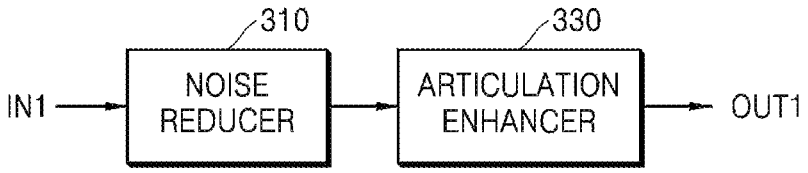
FIG. 3 is a block diagram of a configuration of a signal processing apparatus, according to another embodiment.

FIG. 3 is a block diagram of a configuration of a signal processing apparatus, according to another embodiment, which may correspond to the signal changer 133 of FIG. 1.

The apparatus of FIG. 3 may include a noise reducer 310 and an articulation enhancer 330. The articulation enhancer 330 may be implemented as shown in FIG. 2, and the noise reducer 310 may reduce noise from an overall receiving signal by using a noise signal received via a microphone.

A representative noise reduction technology may include an active noise control (ANC) method, in detail, a feedforward type, a feedback type, and a virtual sensing type.

A feedforward ANC method operates in a wide bandwidth and is capable of noise removal up to about 3 kHz band, so as to stably operate in a high frequency range corresponding to a voice band during a voice call. A high frequency component may make a voice signal to be identified more clearly.

A feedback ANC method may exhibit high performance in a lower frequency range compared with the feedforward ANC method, in general, in a range equal to or less than 100 Hz, and may be operable up to about 1 kHz. A feedback ANC technology may be suitable for a voice signal than an audio signal and may have effective performance to wind noise compared with the feedforward ANC technology.

A virtual sensing method is a noise control technology using virtual noise existing at a virtual position, not at an actual position of a microphone, which uses an acoustic transfer function of an actual microphone position and a transfer function obtained from a transfer function with respect to a virtual position. For the virtual sensing method, the ANC is performed based on prediction noise considering a delay time to a virtual position.

The ANC method is a technology for removing noise by outputting to the speaker an anti-phase signal of a noise signal obtained by using a microphone, thereby offsetting the noise signal with the anti-phase signal. A signal generated as a result of summing the noise signal and the anti-phase signal is referred to as an error signal, and ideally, as a result of the offset interference between the noise signal and the anti-phase signal, the noise signal is completely removed and thus an error signal becomes 0.

However, it is practically impossible to completely remove noise and when synchronism or phase of the anti-phase signal and the noise signal does not accurately match with each other, noise may be rather amplified by constructive interference. Accordingly, according to a noisy environment embodiment, noise may be stably controlled by adjusting the size of an anti-phase signal or the output of an ANC module. In the ANC technology, an error signal is obtained via an error microphone, and an anti-phase signal reflecting the error signal is generated, and thus noise is may be controlled adaptively or actively. The anti-phase signal, the error signal, and the prediction noise signal may be output signals of the ANC module, and in the specification, a noise reduction signal, an ANC signal, or an ANC signal may denote an output signal of the noise reducer 310.

The ANC technology is, in general, effective in removing dominant noise of a low frequency range. In contrast, articulation of a voice signal is determined mainly by a signal of a high frequency range.

Accordingly, as noise is physically removed by using an active noise removal technology with respect to a low frequency range, objective signal quality may be improved, and subjective signal quality may be improved by changing a voice signal to perceptively improve articulation with respect to the high frequency range.

Figure 4:
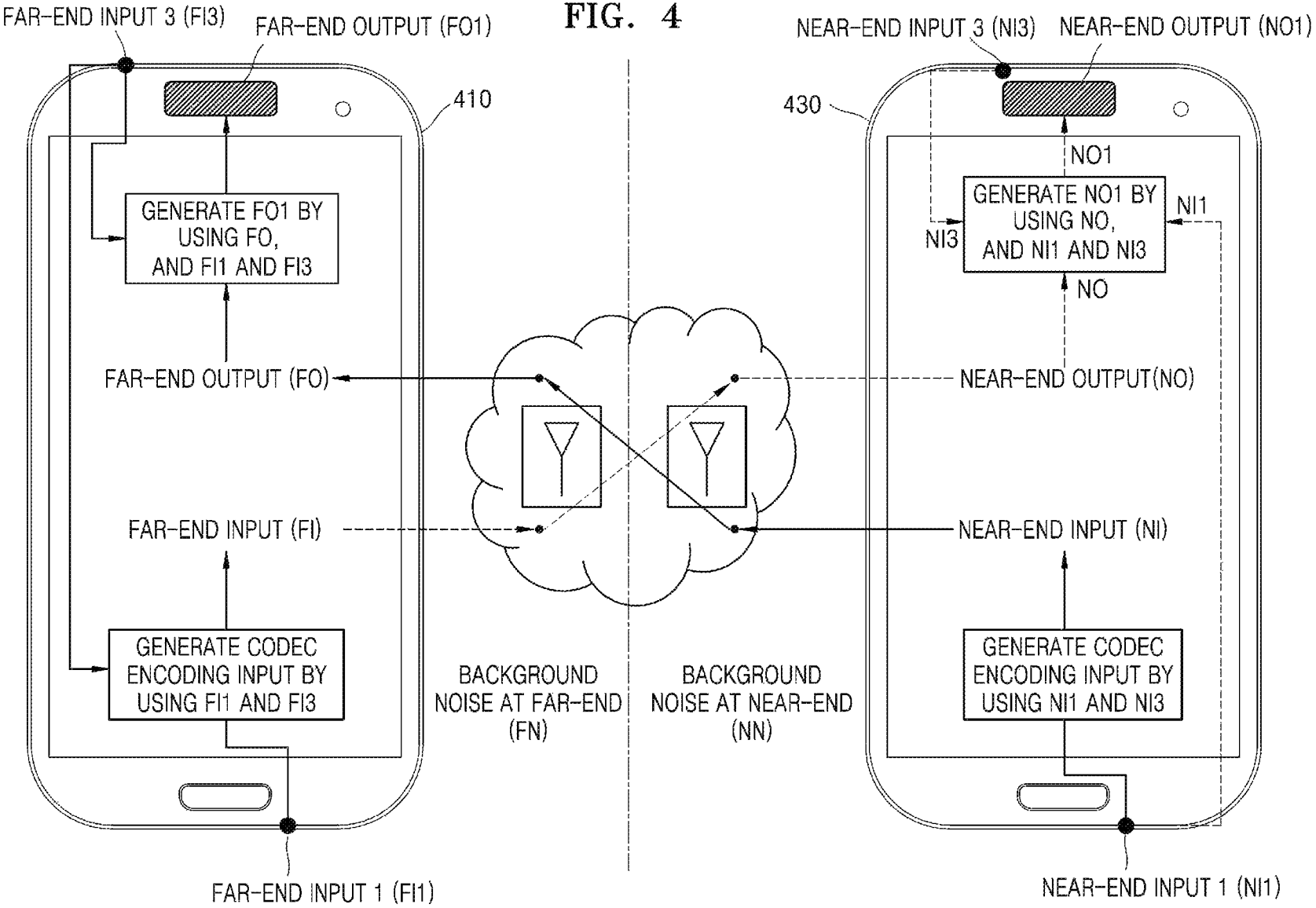
FIG. 4 illustrates signals for generating far-end input/output and near-end input/output in a far-end device and a near-end device, according to an embodiment.

FIG. 4 illustrates signals for generating far-end input/output and near-end input/output in a far-end device 410 and a near-end device 430, according to an embodiment, in which two microphones are installed at a terminal. In this regard, noise Nil from a first microphone located at a lower end or at a front surface or a rear surface of the lower end for noise control and articulation improvement and noise NI3 from a third microphone located at a top end or at a front surface or a rear surface of the top end may be used.

A near-end output NO is a signal that a far-end input voice signal FI transmits to the near-end device 430 via a network, and thus an output signal NO1 is finally generated by using the near-end noises NI1 and NI3 received via a microphone of the near-end device 430.

Although FIG. 4 illustrates a case in which two microphones are installed at a terminal, the signal processing apparatus according to an embodiment is not limited to the number and/or position of microphones.

Figure 5:
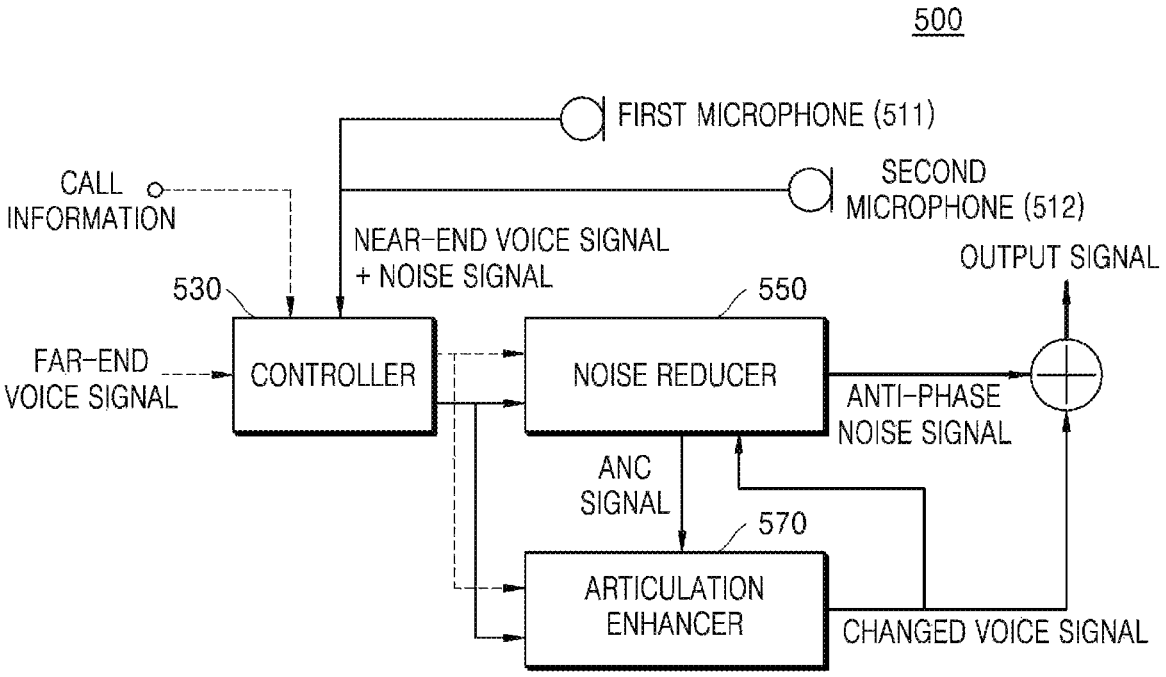
FIG. 5 illustrates an operation of a signal processing apparatus, according to an embodiment of the disclosure.

FIG. 5 illustrates an operation of a signal processing apparatus 500, according to an embodiment.

The signal processing apparatus 500 disclosed in the embodiment of FIG. 5 may include microphone portions 511 and 512, a controller 530, a noise reducer 550, and an articulation enhancer 570. A solid line denotes a flow of voice signals and noise signals processed in the noise reducer 550 and the articulation enhancer 570, and a dotted line denotes a flow of control signals for control ling the respective processors.

The microphone portions 511 and 512 may include a first microphone 511 corresponding to a reference microphone and a second microphone 512 corresponding to the error microphone, and for ANC to a near-end noise signal, the reference microphone may obtain a reference noise signal and the error microphone may obtain an error signal. The reference microphone and the error microphone each may include a plurality of microphones.

The controller 530 may control operations of the noise reducer 550 and the articulation enhancer 570 based on the near-end voice signal and the near-end noise signal obtained from the first microphone 511 and the second microphone 512, a far-end voice signal transmitted by a far-end terminal, and information about an incoming call received from the far-end terminal. According to an embodiment, the controller 530 may determine a noise control parameter to be applied to the noise reducer 550, based on at least one of information about the near-end voice signal, information about the near-end noise signal, or information about the far-end voice signal.

The noise control parameter may denote parameters to be used for ANC, and may denote at least one piece of information related to use of the noise reducer 550, output power of the noise reducer 550, a gain to be applied to the noise control signal, a weight, and a frequency operation range of the noise reducer 550.

The controller 530 may determine a noise control parameter to be applied to the noise reducer 550 based on the amplitude, frequency band, and type of the near-end noise signal.

For example, when a noise signal mainly exists in a low frequency range or a dominant noise exists in a low frequency range as a result of the analysis of components of the near-end noise signal for each frequency, the controller 530 may determine the output of the noise reducer 550 to be high. Reversely, when a noise signal mainly exists in a high frequency range or a dominant noise exists in a high frequency range as a result of the analysis of components of the near-end noise signal for each frequency, the controller 530 may determine the output of the noise reducer 550 to be low or may determine the noise reducer 550 not to operate. Alternatively, the controller 530 may determine the frequency operation range of the noise reducer 550 based on the frequency band of the near-end noise signal.

The controller 530 may determine a weight to be applied to the output of the noise reducer 550.

For example, in a virtual sensing method, when a prediction noise signal is different from an actual noise signal or the phase of an anti-phase signal is not synchronized with the actual noise signal, the noise reducer 550 may exhibit stable noise reduction performance by applying the determined weight to the output.

The controller 530 may determine the type and feature of the far-end signal based on codec information, codec's core mode information, or discontinuous transmission (DTX) information included in a bitstream of the far-end voice signal, and may determine the noise control parameter on the basis thereof.

For example, the controller 530 may determine whether the far-end signal is a voice signal or a music signal based on a core encoding mode of an EVS codec. The ANC technology, in particular, a feedback type ANC technology, exhibits high noise removal performance in a low frequency range corresponding to a range of a voice signal. However, with respect to the high frequency range signal, the ANC technology may have low noise removal performance and rather deteriorate sound quality. Accordingly, when the far-end signal is determined to be a voice signal, the controller 530 may determine an output to be applied to the noise reducer 550 to be high, and when the far-end signal is not determined to be a voice signal, the controller 530 may determine an output to be applied to the noise reducer 550 to be low or may determine not to operate the noise reducer 550.

DTX, which is a function o stop transmission when there is no data to be transmitted, may be used to reduce interference and for efficient use of resource, and may be used with a voice activity detection (VAD) function of an encoder in voice communication.

For example, when DTX is set to 1 as a result of checking the bitstream of a received far-end voice signal, it is a state in which no far-end input signal exists, and thus the controller 530 may determine to reduce the output of the noise reducer 550 or not to operate the noise reducer 550.

According to another embodiment, the controller 530 may determine a voice signal change parameter to be applied to the articulation enhancer 570, based on at least one of information about the near-end voice signal, information about the near-end noise signal, or information about the far-end voice signal.

The voice signal change parameter may denote parameters to be used to change a voice signal to improve articulation of a far-end voice signal, and may denote at least one of pieces of information regarding whether to use the articulation enhancer, output power of the articulation enhancer, frequency operation range of the articulation enhancer, or the articulation improvement method.

The controller 530 may determine a voice signal change parameter to be applied to the articulation enhancer 570, based on the amplitude, frequency band, and type of the near-end noise signal.

As described above, the controller 530 may determine the output of the noise reducer 550 based on the amplitude and frequency band of a near-end noise signal. As resource of the overall system is limited, the outputs of the noise reducer 550 and the articulation enhancer 570 are relative to each other, and it is necessary to determine an optimal output for each module considering the limited resource and the system improvement performance. Furthermore, the controller 530 may determine a frequency operation range of the articulation enhancer 570 based on the frequency band of the near-end noise signal.

Alternatively, the controller 530 may determine a voice signal change parameter based on the type of a near-end noise signal, for example, whether it is an interfering talk or an ambient noise regardless of whether the noise signal is a near-end voice or a far-end voice.

The controller 530 may determine the type and feature of a far-end signal based. on codec information, codec's core mode information, or DTX information included in a bitstream of the far-end voice signal, and may determine a voice signal change parameter on the basis thereof.

For example, the controller 530 may determine whether the far-end signal is a voice signal or a music signal, based on the core encoding mode of an EVS codec. The articulation improvement is generally applied mainly to a voice call, and thus when the far-end signal is determined to be a voice signal, the controller 530 may determine an output to be applied to the articulation enhancer 570 to be high, and when the far-end signal is not determined to be a voice signal, the controller 530 may determine an output of the articulation enhancer 570 to be low or may determine not to operate the articulation enhancer 570.

DTX, which is a function to stop transmission when there is no data to be transmitted, may be used to reduce interference and for efficient use of resource, and may be used with a voice activity detection (VAD) function of an encoder in voice communication.

For example, when DTX is set to 1 as a result of checking the bitstream of a received far-end voice signal, it is a state in which no far-end input signal exists, and thus the controller 530 may determine to reduce the output of the articulation enhancer 570 or not to operate the articulation enhancer 570. Alternatively, when voice activity is detected from the VAD of the received near-end voice signal, a noise signal may be analyzed by using the detected voice activity, and the controller 530 may determine the output of the articulation enhancer 570 based on the VAD.

The noise reducer 550 generates an anti-phase signal based on the noise control parameter determined by the controller 530. The noise reducer 550 may transmit the anti-phase signal and the error signal to the articulation enhancer 570, and thus the far-end voice signal is changed in an environment in which noise is physically reduced, thereby improving articulation.

When the noise reducer 550 uses a virtual sensing method, a prediction noise signal may be additionally transmitted to the articulation enhancer 570. The virtual sensing method and the respective signals of the noise reducer 550 are described below. In this case, the noise reduction signal may include at least one of the reference noise signal, the anti-phase signal, the error signal, or the prediction noise signal.

The articulation enhancer 570 may change the far-end voice signal on the bases of the voice signal change parameter determined by the controller 530. The articulation enhancer 570 may improve articulation by changing the far-end voice signal based on the noise to be reduced by using the noise reduction information transmitted from the noise reducer 550. The noise reduction information may be the reference noise signal, the anti-phase signal, or the error signal which are obtained from the noise reducer 550, or relevant information.

According to an embodiment of the disclosure, the controller 530 may control the noise reducer 550 and the articulation enhancer 570 to selectively operate.

Furthermore, the noise reducer 550 may further reduce noise by using information about the changed far-end voice signal transmitted from the articulation enhancer 570. For example, when noise is included in the far-end voice signal, noise reduction performance may deteriorate, and thus when the far-end voice signal is checked and noise over a certain level is found to be included, the noise reduction method may be changed or a noise reduction level may be adjusted.

According to the articulation improvement method according to an embodiment of the disclosure, it is not that the near-end noise signal to which the noise control technology is applied and the far-end voice signal changed by using the articulation improvement technology are simply combined with each other, but that the articulation improvement technology is adopted in an environment in which noise is physically reduced by the noise control technology, and thus not only the subjective sound quality but also objective sound quality may be improved.

As a noise signal has a very fast change speed to time, performance may be guaranteed when the noise reducer 550 has a fast response speed to time, and the articulation enhancer 570 may be adaptively performed according to a change feature of a noise signal to a relatively long time.

The articulation enhancer 570 may output a changed voice signal through the articulation improvement processing, and the changed voice signal is summed with the anti-phase signal of the noise reducer 550 and then output. When the noise signal and the anti-phase signal of the noise signal are summed, destructive interference is generated and thus the noise signal may be reduced.

Figure 6:
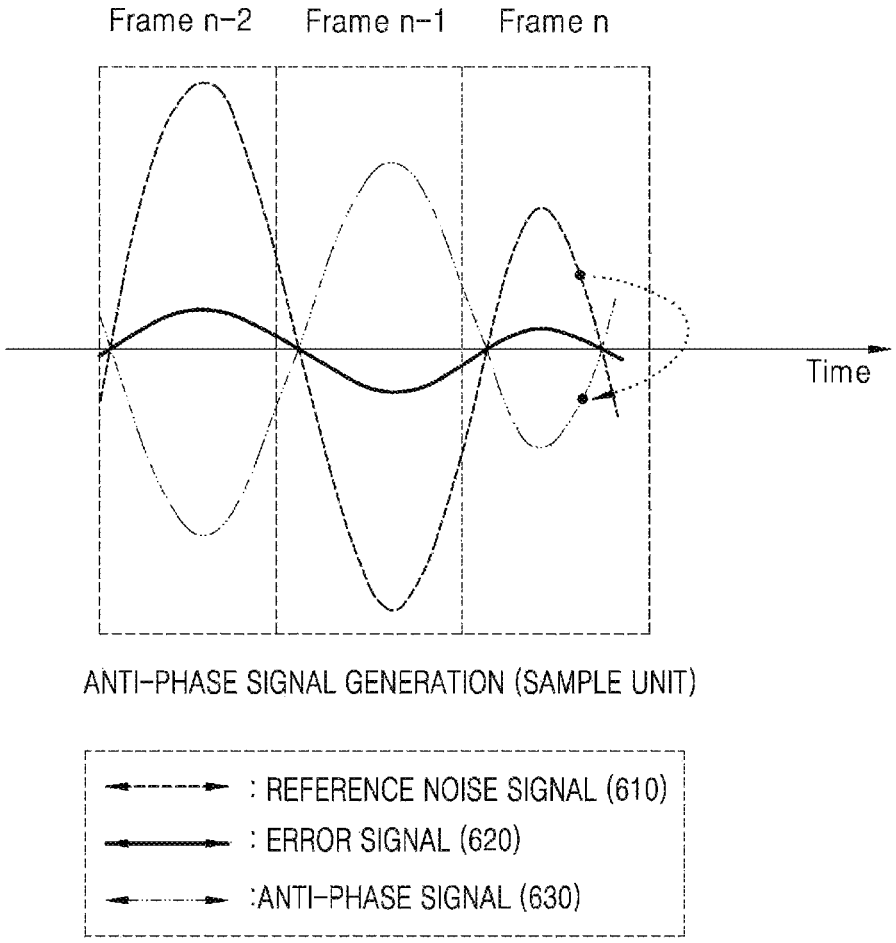
FIG. 6 illustrates signals related to a noise reducer, according to an embodiment.

FIG. 6 illustrates signals related to the noise reducer 550, according to an embodiment.

As described above, the ANC or the active noise removal (active noise cancellation) technology generates a noise signal y(n), that is, an anti-phase signal, having a phase opposite to that of a noise x(n) input through a microphone, and sums the anti-phase signal and the original signal, thereby reducing noise.

A signal generated as a result of summing the noise signal and the anti-phase signal is an error signal e(n), and ideally the noise signal is completely removed as a result of destructive interference between the noise signal x(n) and the anti-phase signal y(n) so that the error signal e(n) becomes 0.

However, the completely removing noise is practically impossible, and when the synchronism or phase between the anti-phase signal and the noise signal is not accurately matched, noise may be rather amplified due to constructive interference. Accordingly, according to a noisy environment or an embodiment, by adjusting the amplitude of an anti-phase signal or the output of an ANC module, the error signal e(n) is actively controlled to be reduced.

The noise reducer 550 may generate an anti-phase signal 630 with respect to an (n-2)th frame based on a reference noise signal 610 with respect to the (n-2)th frame, output the generated anti-phase signal through the speaker, and acquire an error signal 620 with respect to the (n-2)th frame through the second microphone.

The noise reducer 550 may generate the anti-phase signal 630 based on the reference noise signal 610 with respect to an (n-1)th frame, and the error signal acquired at the (n-2)th frame is used. When the error signal hardly exists or is small, the noise reducer 550 may be determined to normally operate, and when the error signal is abnormally large, the anti-phase signal is inappropriately generated, and thus the noise control parameter is newly set and the anti-phase signal 630 for the (n-1)th frame is generated.

The noise reducer 550 may output the generated anti-phase signal 630 for the (n-1)th frame through the speaker, and acquire the error signal 620 for the (n-1)th frame through the second microphone.

As such, the active and adaptive noise control may be possible through the above process.

Figure 7:
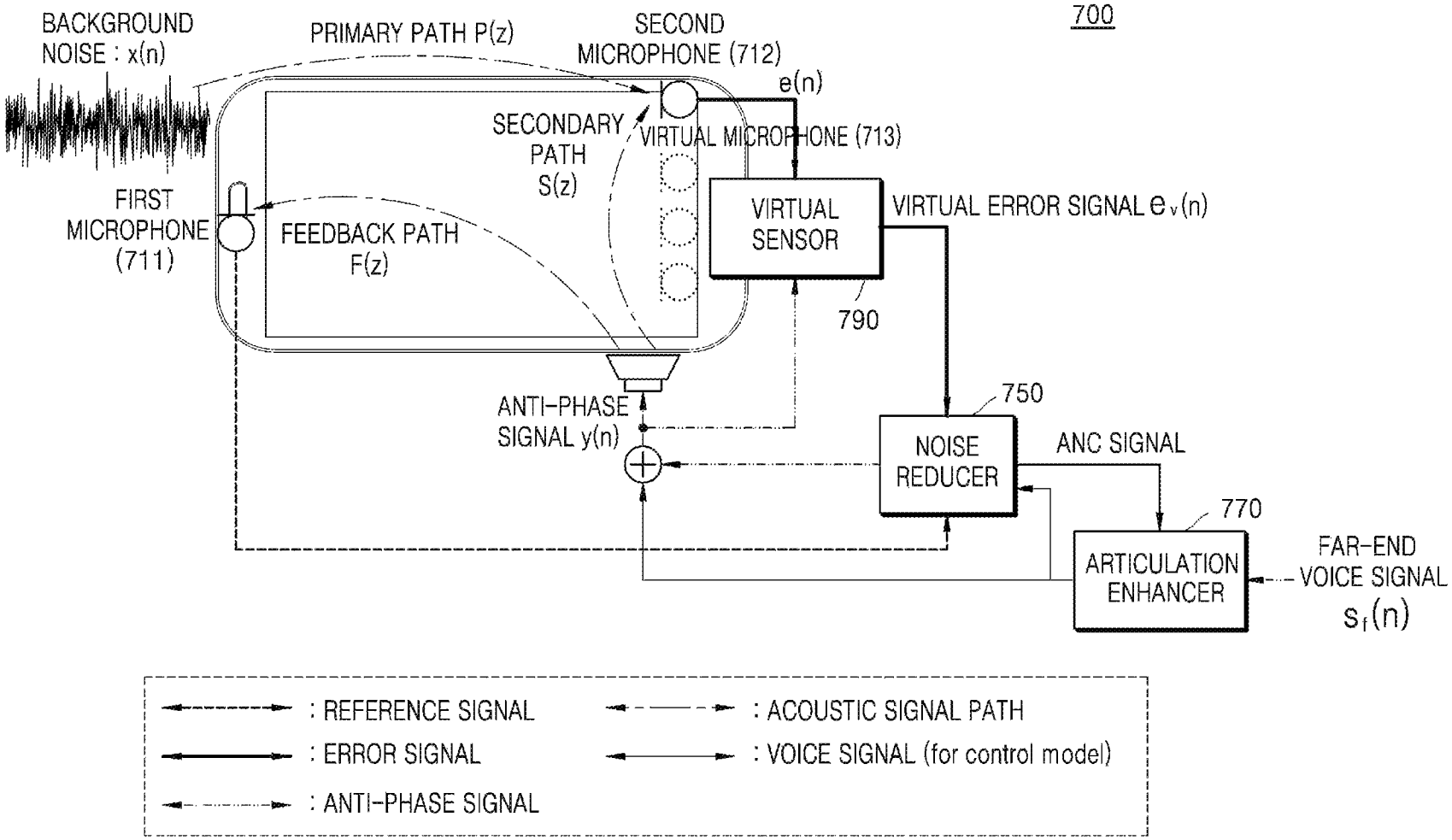
FIG. 7 illustrates a method of generating a voice signal with improved articulation, according to an embodiment.

FIG. 7 illustrates an operation of generating a voice signal with improved articulation by using a prediction reference noise signal based on virtual sensing in a near-end device 700, according to an embodiment.

The near-end device 700 disclose in the embodiment of FIG. 7 may include microphone portions 711 and 712, a controller 730 (not shown), a noise reducer 750, an articulation enhancer 770, and a virtual sensor 790.

The flows and acoustic signal paths of the reference noise signal, the error signal, the anti-phase signal, and the far-end voice signal are indicated by arrows.

A first microphone (reference microphone) 711 is generally located close to the mouth of a terminal user, and the first microphone 711 may receive at least one of a near-end noise signal x(n), an anti-phase signal y(n) received through a feedback path F(z), or a far-end voice signal s_f(n). A second microphone (error microphone) 712 is located close to the ear of a terminal user and to the speaker of the terminal, and the second microphone 712 may receive at least one of the near-end noise signal x(n) received through a primary path P(z) and the anti-phase signal y(n) received through a secondary path S(z)

In the implement of an actual terminal, while the anti-phase signal y(n) output from the speaker does not effect on the first microphone 711 located relatively far from the speaker is not much, the anti-phase signal y(n) may have a large effect on the overall signal processing because the anti-phase signal y(n) is input to the second microphone located close to the speaker.

Although in FIG. 7 it is assumed that, as the anti-phase signal y(n) output from the speaker is directly input to the second microphone 712, the input of the second microphone is x(n) y(n), that is, e(n), the effect of the anti-phase signal input to the second microphone 712 may vary according to an actual implement. According to another embodiment of the disclosure, the background noise signal x(n) and the anti-phase signal y(n) are obtained by separate methods and the two signals are summed so as to produce the error signal e(n).

The embodiment illustrated in FIG. 7 includes the virtual sensor 790, and the virtual sensor 790 generates and outputs an anti-phase signal with respect to a virtual noise signal received at at least one virtual microphone 713 existing at a virtual position, by using the noise signal x(n) received at the first microphone 711.

The position where the background noise is actually reduced is necessarily an ear reference point (ERP) of a listener, that is, the eardrum. Accordingly, although the ideal positions of the speaker and the error microphone are the ERP where sound is perceived, due to the structural limit, the speaker and the error microphone are located at a position where the auricle of a listener is expected to be present, and the error signal e(n) is acquired at the position of the second microphone.

A difference between the listener's ERP and a relative position of a terminal may vary because a terminal holding method differs person to person and the shapes or sizes of auditory organs of speakers are different from each other. When a plurality of microphones are used, more effective signal modeling for noise reduction may be possible, but in a trend of a decrease in size and thickness of a terminal, it may not be easy to install an addition hardware module.

Accordingly, by making a function of a transfer path of sound from the second microphone 712 to listener's ERP, sound generated from at least one virtual microphone position may be predicted so as to estimate a virtual error signal e_v(n).

In this state, as the position of the second microphone 712 is closer to the position of the speaker's ear, noise removal performance is improved, and thus a position of the virtual microphone may be set to the position of the speaker's ear measured through separate sensing.

According to another embodiment, even when the second microphone 712 is difficult to be located at a position where the speaker's ear is highly likely to be located, improved noise removal performance may be obtained by using the virtual sensing.

According to another embodiment, a virtual sensing-based noise reduction technology may generate a plurality of prediction error signals when a plurality of reference noise signals received through a plurality of reference microphones exist, and thus effective noise removal is possible.

When a prediction error signal by virtual sensing is use, performance deterioration may occur when the position of virtual sensing is not matched or a prediction error signal is not matched with an actual signal, and in this case, the performance deterioration may be prevented by applying a weight to an output signal of the noise reducer 750.

The noise reducer 750 may acquire an anti-phase signal by generating a prediction reference noise signal from the reference noise signal and the virtual error signal, and transfer the acquired anti-phase signal, reference noise signal, prediction reference noise signal, and error signal to the articulation enhancer 770. In the specification, the noise reduction signal may denote the reference noise signal, prediction reference noise signal, anti-phase signal, and error signal which are input/output signals of the noise reducer 750.

The articulation enhancer 770 may enhance articulation by processing the far-end voice signal s_f(n), and output the far-end voice signal with improved articulation to the speaker with the output signal of the noise reducer 750. When a signal with improved articulation is used in the noise reducer 750, the signal with improved articulation is transmitted to the noise reducer 750.

As such, as noise reduction is performed at a desired position by using a virtual error signal, the deterioration in noise reduction performance due to the difference in user's terminal holding method or the structural difference in user's auditory organs may be prevented.

Figure 8:
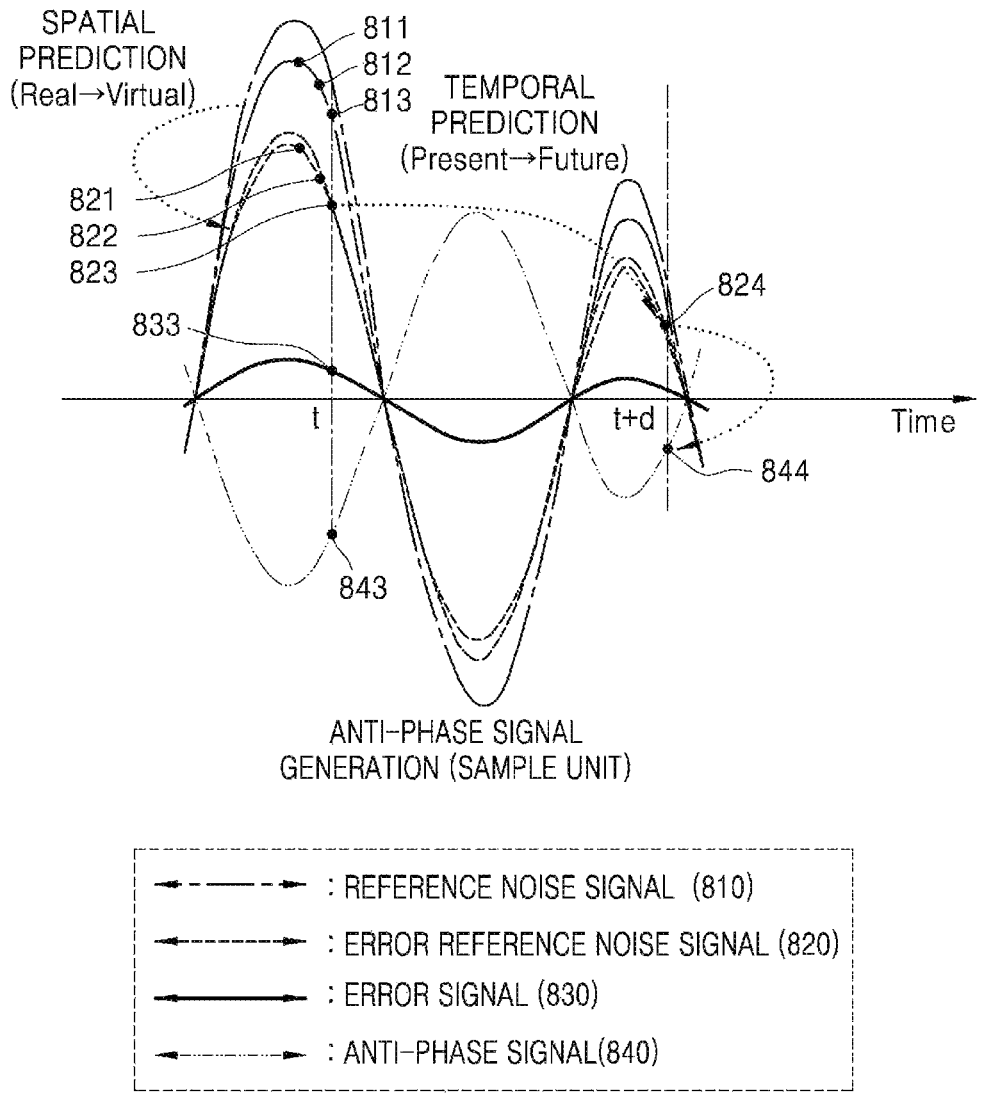
FIG. 8 illustrates respective signals related to the noise reducer, according to another embodiment.

FIG. 8 illustrates respective signals related to the noise reducer 750, according to another embodiment of the disclosure.

The position of an output speaker or headset and the ERP where the listener perceives sound are different from each other. Accordingly, when an output signal is generated with respect to the output speaker (headset), a propagation delay exists between the output signal of the output speaker (headset) and the listener's ERP.

Furthermore, an additional time delay d may exist due to processing, and in the virtual sensing method the additional time delay may be compensated for based on time prediction.

In this state, assuming that a plurality of reference microphones, for example, an L-number of reference microphones, exist, a reference noise signal 810 is an L-channel signal.

A spatial prediction corresponds to a process of reflecting the propagation delay by converting a reference noise signal measured through an actual microphone to a virtual reference noise signal based on the position of the actual microphone and the position of the virtual reference noise signal corresponding to the ERP. As a result, a reference noise signal 811, a reference noise signal 812, and a reference noise signal 813 are converted to a prediction reference noise signal 821, a prediction reference noise signal 822, and a prediction reference noise signal 823, respectively.

A temporal prediction is a process of predicting a future signal based on a present signal by reflecting an additional delay due to processing. As a result, a prediction reference noise signal 823 of a reference time t is converted to a prediction reference noise signal 824 of t+d by reflecting the additional delay.

The noise reducer 750 of the signal processing apparatus according to an embodiment of the disclosure may generate an anti-phase signal 840 from the prediction reference noise signal 824 produced through the process of spatial prediction and temporal prediction. Accordingly, the anti-phase signal 840 corresponds to the prediction reference noise signal 820, and an error signal 830 is produced by summing the prediction reference noise signal 820 and the anti-phase signal 840.

Figure 9:
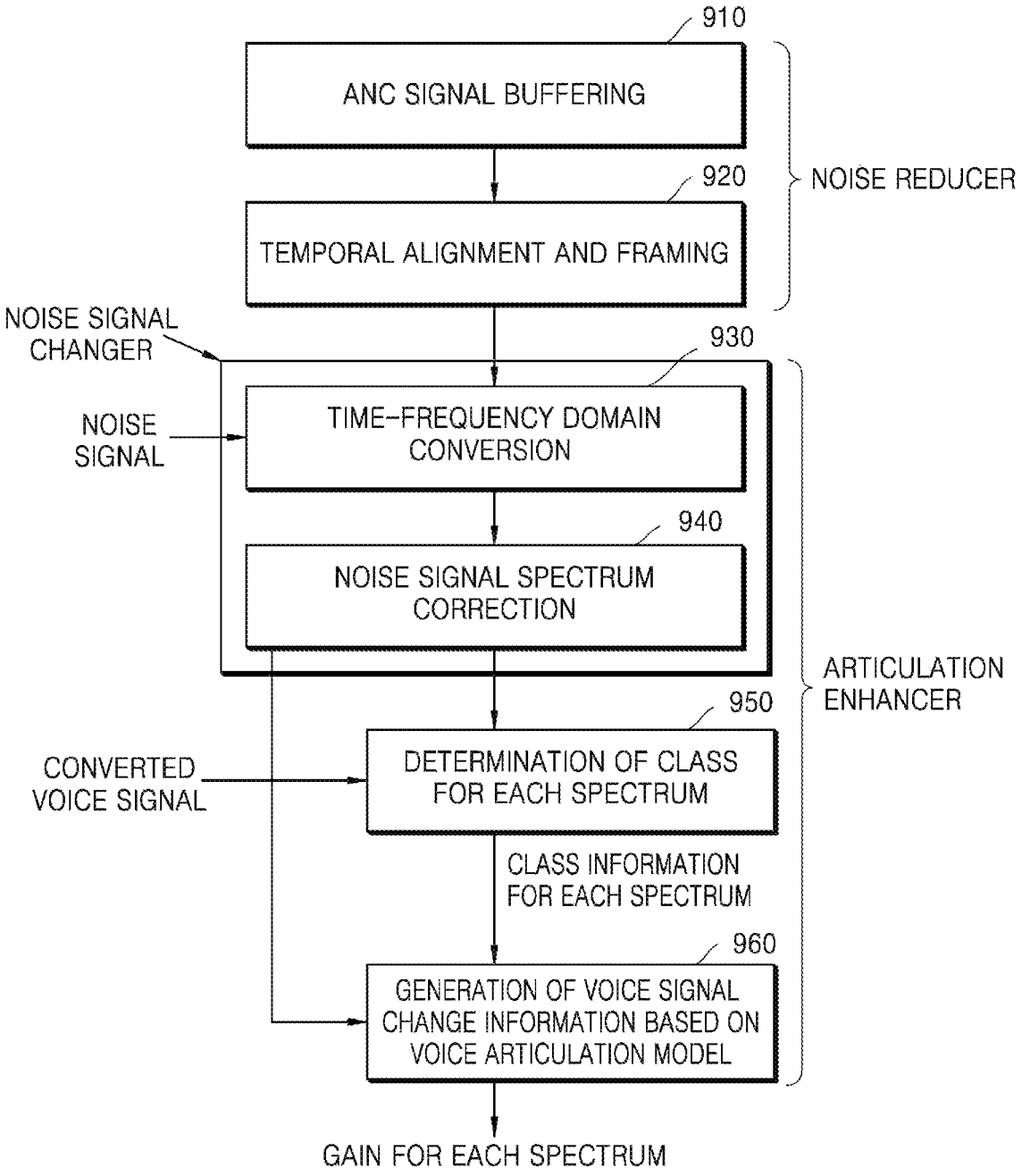
FIG. 9 is a flowchart of a method of generating a voice signal with improved articulation, according to an embodiment.

FIG. 9 is a flowchart of a method of generating a voice signal with improved articulation, according to an embodiment.

When an anti-phase signal is determined in a noise reducer determines and an error signal is acquired, in the noise reducer, the anti-phase signal and the error signal are buffered (910), and each signal is temporally aligned and framed (920) to match time and frame sync with an articulation enhancer.

The articulation enhancer may further include a noise signal changer. In the noise signal changer, a noise signal and an output signal of the noise reducer, that is, the anti-phase signal and the error signal, are time-frequency converted (930), and a spectrum of the noise signal is corrected in a frequency domain based on the output signal of the noise reducer (940), thereby changing the noise signal.

In the articulation enhancer, a class for each spectrum of the voice signal converted is determined based on the changed noise signal (950), and voice signal change information is generated based on the class for each piece of the spectrum information of the voice signal (960) and a gain for each spectrum is output.

According to an embodiment of the disclosure, a voice signal change method may be determined based on the voice articulation model, in detail, auditory perception importance or a voice speaking pattern.

Figure 10:
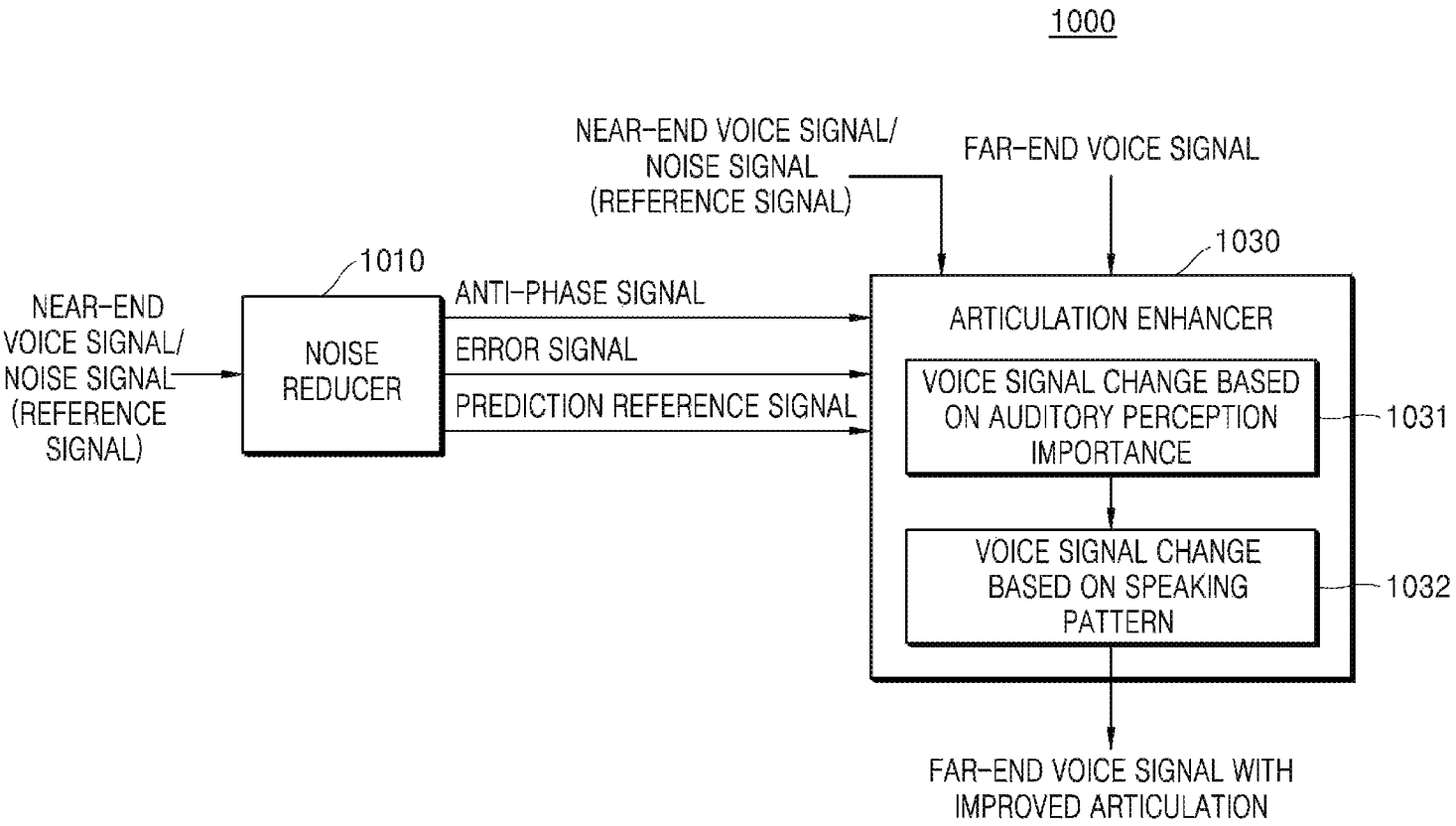
FIG. 10 is a block diagram of operations of the noise reducer and an articulation enhancer in the near-end device, according to an embodiment.

FIG. 10 is a block diagram of operations of a noise reducer 1010 and an articulation enhancer 1030 in the near-end device, according to an embodiment.

The noise reducer 1010 according to an embodiment of the disclosure may receive a near-end voice signal and a noise signal (reference noise signal) and output at least one of an anti-phase signal, an error signal, and a prediction reference noise signal on the basis thereof.

The articulation enhancer 1030 according to an embodiment of the disclosure may receive a far-end voice signal in addition to the near-end voice signal and the noise signal (reference noise signal), and change a voice signal based on auditory perception importance (1031) and change a voice signal based on a speaking pattern (1032), thereby outputting a far-end voice signal with improved articulation.

According to an embodiment of the disclosure, a process of changing a voice signal based on auditory perception importance (1031) may be performed in the first articulation enhancer 230 of FIG. 2, a process of changing a voice signal based on a speaking pattern (1032) may be performed in the second articulation enhancer 250, and the first articulation enhancer 230 and the second articulation enhancer 250 may be selectively operated according to the determination of the mode determiner 210.

In this state, the articulation enhancer 1030 may buffer a real-time noise control signal and then adopt the articulation improvement method with respect to information about noise that is actually heard in the ear.

According to another embodiment of the disclosure, the noise reducer 1010 may use information about the changed voice signal output from the articulation enhancer 1030, and in this case, the noise reducer 1010 is required to have a very fast response speed and the articulation enhancer 1030 needs to be slowly adapted according to a change pattern of the noise signal.

Figure 11:
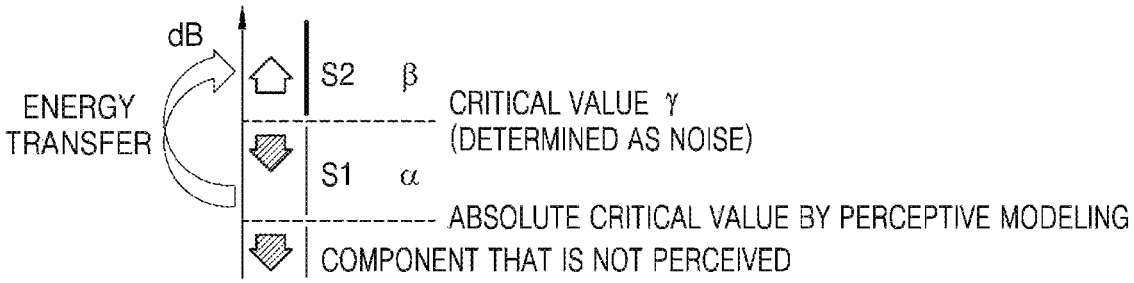
FIG. 11 illustrates a method of improving voice articulation based on auditory perception importance, according to an embodiment.

FIG. 11 illustrates a method of improving voice articulation based on auditory perception importance, according to an embodiment.

The objective of the voice articulation improvement method according to an embodiment of the disclosure is making a voice signal (S+N) perceived in an environment having a large ambient noise signal N similar to a voice signal S perceived in an environment having no ambient noise signal. In other words, in detail, to increase a signal-to-noise ratio (SNR) of the voice signal S and the noise signal N, an error signal including noise between the voice signal (STIR) and the voice signal S is reduced.

The voice signal S may be classified into a signal S1 and a signal S2 in a frequency band based on the auditory perception importance. The signal S1 corresponds to a signal of a frequency band that does not affect much on the articulation improvement based on a perceptive model. The signal S2 corresponds to a signal of a frequency band that affects much on the articulation improvement based on the perceptive model.

The voice signal (S+N) including noise may be presented as in [Formula1].

$$\alpha S1+\beta S2+\gamma N \quad \text{[Formula 1]}$$

In this case, an error signal between the voice signal (S+N) including noise and the voice signal S is presented as in [Formula 2].

$$S-(\alpha S1+\beta S2+\gamma N) \quad \text{[Formula 2]}$$

A least square error (LSE) of the error signal may be presented as in [Formula 3].

$$\min\{[S-(\alpha S1+\beta S2+\gamma N)]\hat{}\ 2\} \quad \text{[Formula 3]}$$

For ideal articulation improvement, in the voice signal (S+N) including noise, S1 and N correspond to components to be reduced and S2 corresponds to a component to be increased.

In other words, as coefficients α, β, and γ of each signal satisfying [Formula 3] are selected, the voice signal S and the noise signal N are increased and thus articulation is improved. In order to satisfy [Formula 3], α is decreased, β is increased, and γ is determined according to the characteristics of noise. Such a process corresponds to a process of transferring energy in a band in which no sound is perceived and a band corresponding to the signal S1 to a band corresponding to the signal S2.

The signal S1 and the signal S2 are not distinguished by a continuous frequency band. A voice signal is classified into a plurality of classes in units of frequency spectrums and whether to increase, decrease, or maintain energy of a class is determined for each class, and a signal corresponding to a class to be decreased is referred to as the signal S1 and a signal corresponding to a class to be increased is referred to as the signal S2.

Furthermore, in [Formula 1] to [Formula 3], it is noted that a description about a signal corresponding to a class for which energy is maintained is omitted.

As illustrated in FIG. 11, the S1 band signal and the band in which no sound is perceived are determined by an absolute critical value according to perceptive mode.

In the process from [Formula 1] to [Formula 3], (fβS2+γN) in a signal (αS1+βS2+γN) is treated as noise, a portion corresponding to a boundary between the signal S1 and the signal S2 may be interpreted to be set to a new critical value.

According to another embodiment of the disclosure, [Formula 3] may be changed to [Formula 4] by using a weight W based on the perceptive model.

$$\min\{W[S-(\alpha S1+\beta S2+\gamma N)]\hat{}\ 2\} \quad \text{[Formula 4]}$$

In this case, W, α, β, or γ for articulation improvement may be obtained by a deterministic method.

Figure 12:
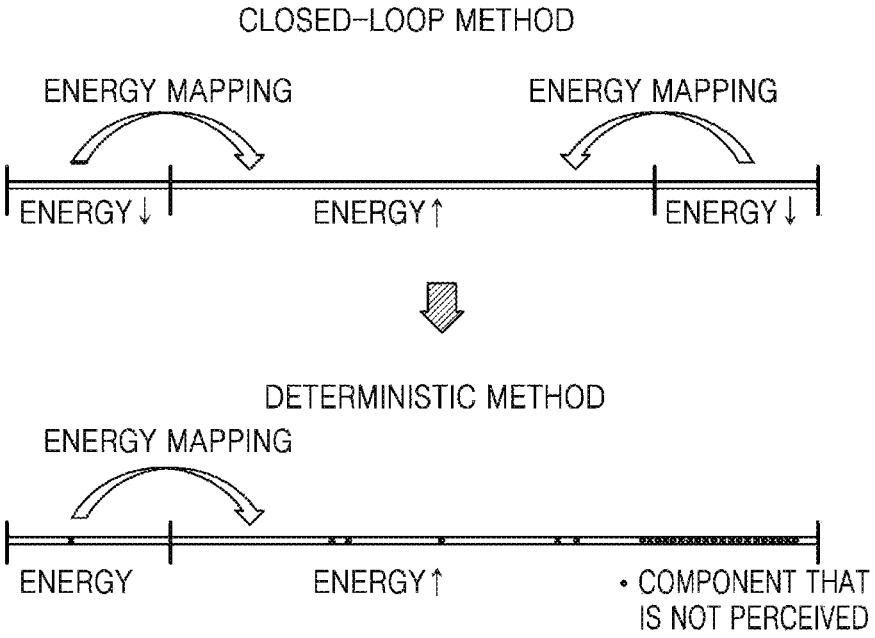
FIG. 12 illustrates an energy exchange relationship between frequency bands of a voice signal in an articulation improvement method, according to an embodiment.

FIG. 12 illustrates an energy exchange relationship between frequency bands of a voice signal in an articulation improvement method, according to an embodiment.

A method of determining a decreased energy amount of the signal S1, an increased energy amount of the signal S2, and a decreased energy amount of a signal having a component that is not perceived based on the perceptive model according to an embodiment of the disclosure determines an energy exchange relationship in the form of a closed-loop so as to change the voice signal, thereby improving articulation.

A method of determining a decreased energy amount of the signal S1 and an increased energy amount of the signal S2 which reduces a mean square error (MSE) of the voice signal (S+N) including the voice signal S and noise, according to another embodiment of the disclosure, changes a voice signal according to a deterministic method considering the energy exchange relationship, thereby improving articulation. According to the methods, as a signal is processed according to the classified frequency band class, processing for each frequency component may be possible and objective measuring performance may be improved.

Figure 13:
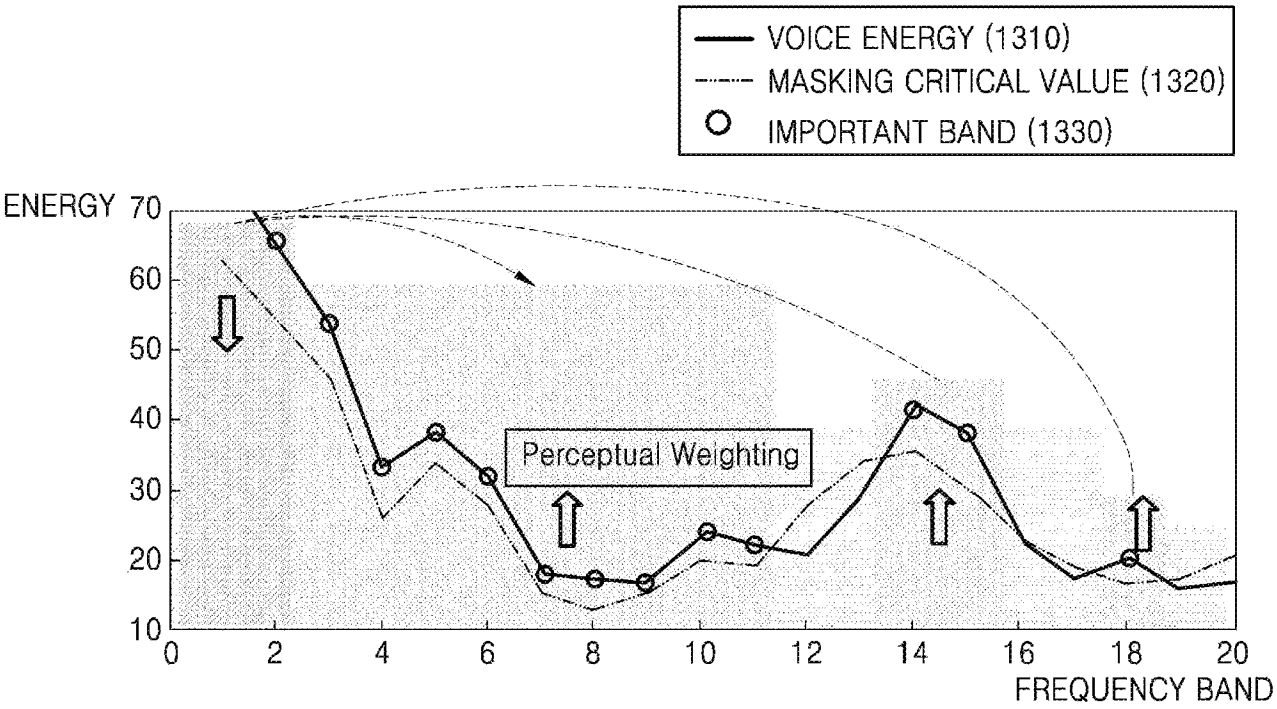
FIG. 13 illustrates an energy change for each frequency band when a voice signal is changed based on the auditory perception importance, according to an embodiment.

FIG. 13 illustrates an energy change for each frequency band when a voice signal is changed based on the auditory perception importance, according to an embodiment.

A line 1310 denotes energy of a voice signal according to a frequency band, and a line 1320 denotes a masking critical value for determining whether to increase or decrease an energy level of a signal. A line 1330 denotes important bands in determining articulation of voice considering the auditory perception importance based on a psychoacoustic model, which is indicated as a circle on the line 1310 indicating energy of a voice signal on the graph.

In the line 1310 denoting the energy of a voice signal according to the frequency band, a signal of a frequency band 1 corresponds to a low frequency signal and does not have a significant effect on psychoacoustically determining voice articulation. However, the signal of the frequency band 1 has an energy level higher than the signals of the other frequency bands.

Furthermore, signals of frequency bands 12, 13, 16, 17, 19, and 20 are also excluded from the important band for determining voice articulation. It may be checked in FIG. 13 by comparing the energy level 1310 and the masking critical level 1320 of each band signal, and thus the masking critical values of the frequency bands 12, 13, 16, 17, 19, and 20 are greater than the voice signal energy levels in corresponding sections.

Accordingly, the energy of signals of the frequency bands 1, 12, 13, 16, 17, 19, and 20 are appropriately distributed as important bands so as to be used to increase the energy level of an important band signal. In particular, as the signal of the frequency band 1 has an energy level higher than the signals of the other frequency bands, the energy of the signal of the frequency band 1 may be distributed to sections S2_1, S2_1, and S2_3 of various important band signals.

Figure 14:
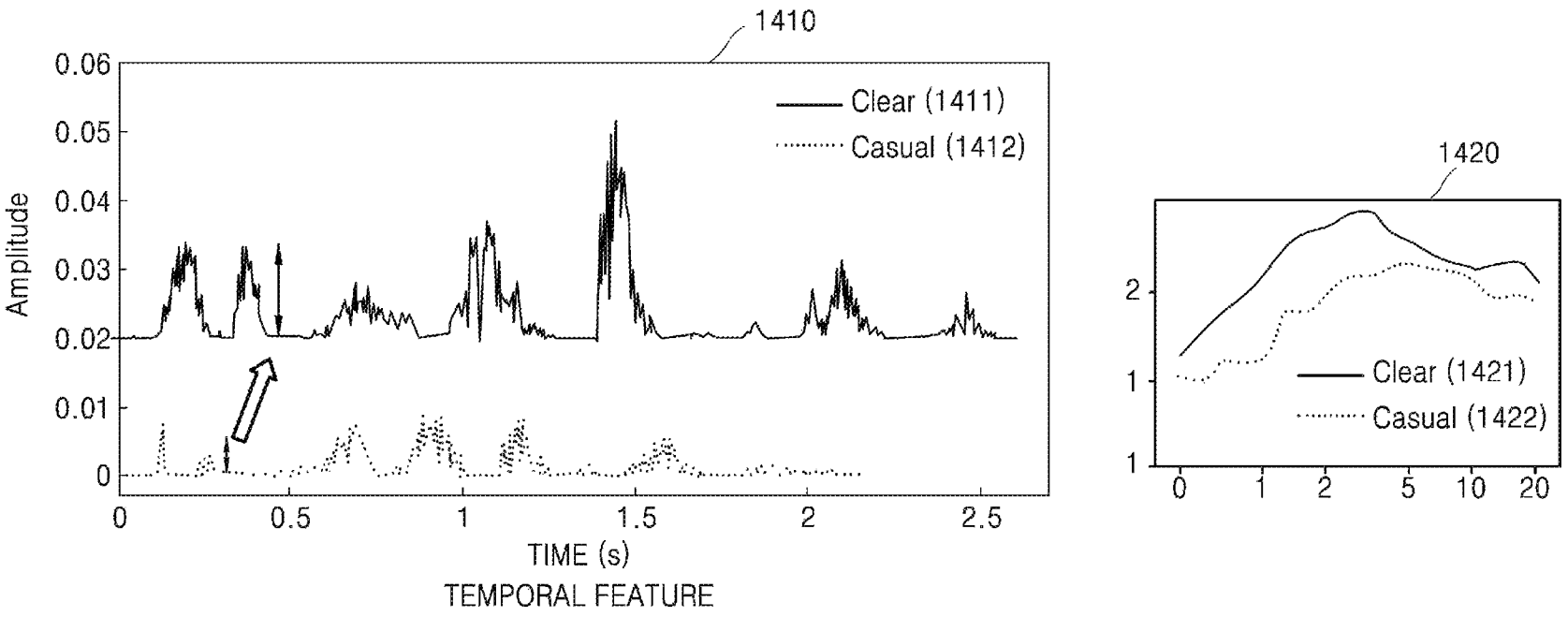
FIG. 14 illustrates a method of improving articulation of a voice signal by changing the voice signal based on a speaking pattern of the voice signal, according to an embodiment.

FIG. 14 illustrates a method of improving articulation of a voice signal by changing the voice signal based on a speaking pattern of the voice signal, according to an embodiment.

A graph 1410 shows a speaking pattern of the voice signal according to the speaking of a speaker, in which a line 1412 denotes a(casual) speaking pattern of the voice signal when a person speaks in general and a line 1411 denotes (clear) speaking pattern of the voice signal when a person speaks with an intention of speaking clearly.

Accordingly, in an environment having a high noise level, a voice signal of a speaker having a feature such as the line 1412 is changed to a signal having a feature such as the line 1411 based on a speaking pattern model according to a noisy environment. As the amplitude of a changed signal is greater than the signal before change, the change signal may have a higher energy level.

A graph 1420 shows modulation indexes of modulation frequencies of a voice signal having a feature such as the line 1411 and a voice signal having a feature such as the line 1412, in which the voice signal changed based on the speaking pattern model has an energy level higher than the voice signal before change, the changed voice signal may be modulated to have a higher modulation index.

Figure 15:
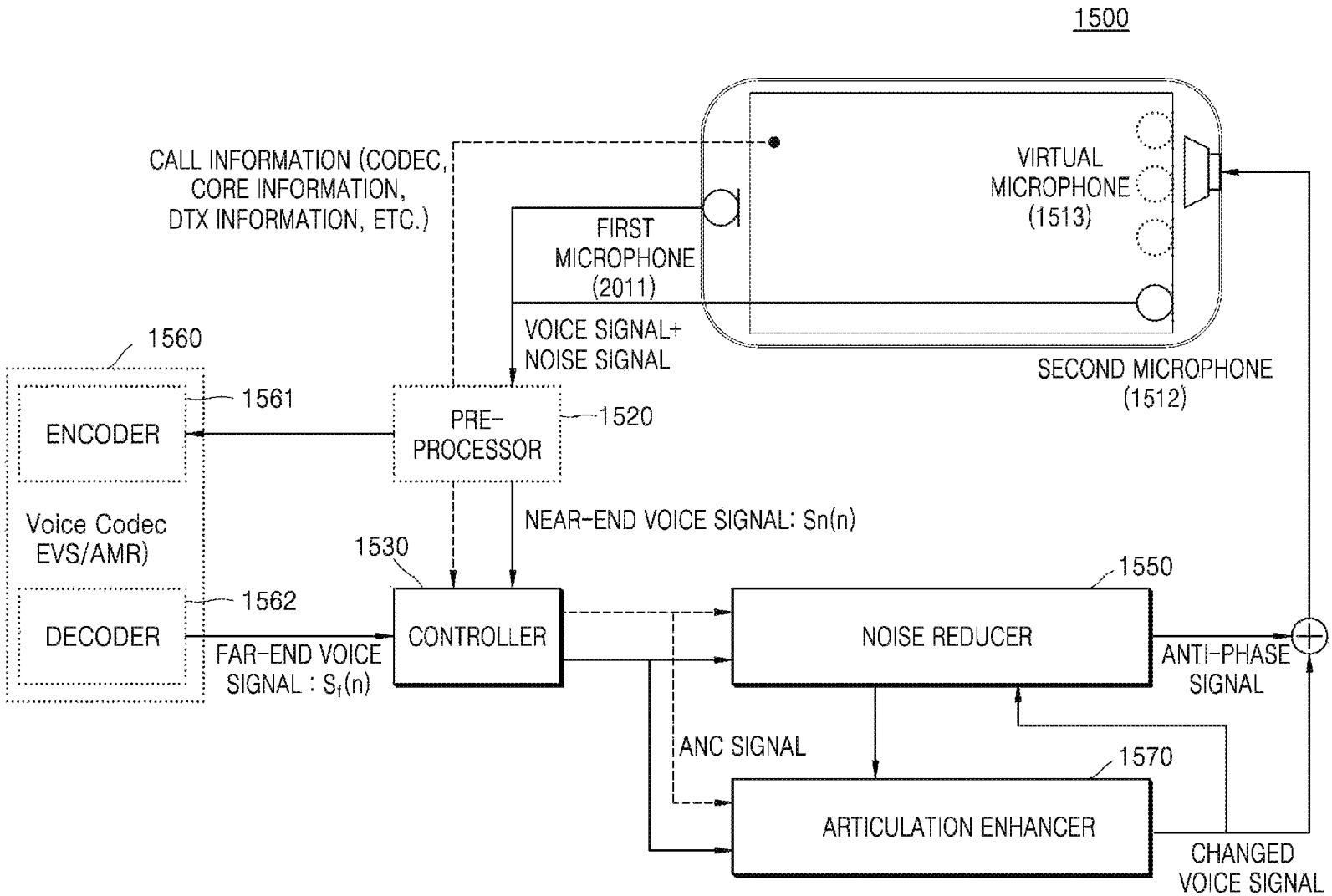
FIG. 15 illustrates an operation of a signal processing apparatus, according to another embodiment.

FIG. 15 illustrates a method of generating a changed signal having improved articulation in a near-end device 1500, according to another embodiment.

The near-end device 1500 of FIG. 15 according to an embodiment may further include a virtual microphone 1513, a pre-processor 1520, and a codec unit 1560, compared with the near-end device 500 of FIG. 5 according to an embodiment.

Pieces of information about a near-end voice signal, a near-end noise signal, a far-end voice signal, and an incoming call from a far-end terminal are transmitted to the pre-processor 1520.

In this case, the near-end voice signal may include all of a noise-voice signal a first microphone 1511 through a first microphone 1511, a noise signal received through a second microphone, and a virtual noise predicted at a position of the virtual microphone 1513, and the far-end voice signal may include a voice signal transmitted from the far-end terminal. The information about an incoming call may include a codec type of the far-end voice signal, a cored mode of a codec, and DTX information.

The pre-processor 1520 pre-processes the received signal to acquire a voice signal, a noise signal, and an error signal and transmits the acquired signals to a controller 1530 and the codec unit 1560 and also transmits information about the transmitted incoming call to the controller 1530 and the codec unit 1560. In this state, the pre-processor 1520 may include an echo canceller.

An encoder 1561 of the codec unit 1560 encodes the near-end voice signal and a decoder 1562 of the codec unit 1560 decodes the far-end voice signal. The codec unit 1560 transmits a far-end voice signal s_f(n) decoded by the decoder 1562 to the controller 1530.

The controller 1530 may control operations of a noise reducer 1550 and an articulation enhancer 1570 based on the near-end voice signal and noise signal, and the far-end voice signal and calling information. The controller 1530 may control an output of the noise reducer 1550 and a power output of the articulation enhancer 1570, or control the operations of the noise reducer 1550 and the articulation enhancer 1570 to selectively operate according to the type of noise.

Alternatively, the controller 1530 may determine noise reduction information of the noise reducer 1550 or a level of articulation improvement of the articulation enhancer 1570 based on the near-end voice signal and noise signal, and the far-end voice signal and calling information.

The noise reducer 1550 may generate an anti-phase signal by using the near-end noise signal and the error signal, As the anti-phase signal of a noise signal is output through the speaker, the noise signal is offset due to destructive interference, and thud noise may be physically reduced.

The articulation enhancer 1570 processes the far-end voice signal, thereby improve articulation. The articulation enhancer 1570 uses a control signal transmitted from the controller 1530 and the noise reduction signal transmitted from the noise reducer 1550 to improve articulation of the far-end voice signal.

According to the articulation improvement method according to an embodiment of the disclosure, it is not that the near-end voice signal to which the noise reduction technology is applied and the far-end voice signal to which the articulation improvement technology is applied are simply combined with each other, but that the articulation improvement technology is adopted based on noise that is physically reduced by the noise control technology, and thus not only subjective sound quality but also objective sound quality may be improved.

The above-described disclosed embodiments may be embodied in form of a program command executable through various computing devices, and may be recorded on a computer-readable medium. The computer-readable medium may include a program command, a data file, a data structure, etc. solely or by combining the same. A program command recorded on the medium may be specially designed and configured for the present disclosure or may be a usable one, such as computer software, which is well known to one of ordinary skill in the art to which the present disclosure pertains to. A computer-readable recording medium may include magnetic media such as hard discs, floppy discs, and magnetic tapes, optical media such as CD-ROM or DVD, magneto-optical media such as floppy disks, and hardware devices such as ROM, RAM flash memory, which are specially configured to store and execute a program command. An example of a program command may include not only machine codes created by a compiler, but also high-level programming language executable by a computer using an interpreter. The above-described hardware apparatuses may be configured to operate as one or more software modules to perform operations according to various embodiments of the present disclosure, or vise versa.

While the present disclosure has been particularly shown and described with reference to preferred embodiments using specific terminologies, the embodiments and terminologies should be considered in descriptive sense only and not for purposes of limitation. Therefore, it will be understood by those of ordinary skill in the art that various changes in form and details may be made therein without departing from the spirit and scope of the present disclosure as defined by the following claims.

Therefore, the scope of the disclosure is defined not by the detailed description of the disclosure but by the appended claims, and all differences within the scope will be construed as being included in the present disclosure.

The invention claimed is:

1. A voice signal processing method comprising:

acquiring a near-end noise signal and a near-end voice signal by using at least one microphone;

acquiring a far-end voice signal transmitted by a far-end terminal;

determining an output power of an anti-phase signal based on information about a frequency band of the near-end noise signal;

determining a signal S1 that does not affect much on articulation improvement and a signal S2 that affects much on articulation improvement among a frequency band of the far-end voice signal, based on information about the frequency band of the far-end voice signal and a auditory perceptual model;

generating the anti-phase signal of the near-end noise signal based on the output power of the anti-phase signal;

changing the far-end voice signal by transferring an energy of a frequency band corresponding to the signal S1 to a frequency band corresponding to the signal S2, to reduce difference between the far-end voice signal including the near-end noise signal and the far-end voice signal; and outputting a sum of the anti-phase signal and the changed far-end voice signal.

2. The voice signal processing method of claim 1, wherein the anti-phase signal comprises an anti-phase signal with respect to a virtual noise signal estimated from the near-end noise signal based on at least one of a different between a position where the near-end noise signal is acquired and a position where the far-end voice signal is perceived or a difference between a time when the near-end noise signal is acquired and a time when the far-end voice signal is perceived.

3. The voice signal processing method of claim 1, wherein the voice signal processing method further comprises:

determining the output power of the anti-phase signal based on at least one of information about encoding of the far-end voice signal and information about whether the far-end voice signal is being output.

4. The voice signal processing method of claim 1, wherein in the changing of the far-end voice signal, a difference between the acquired far-end voice signal and a far-end voice signal in an environment where the near-end noise signal and the anti-phase signal exist is reduced for each frequency band and of a far-end voice signal spectrum.

5. The voice signal processing method of claim 1 wherein the changing of the far-end voice signal comprises:

classifying frequency bands into an energy increase class, an energy decrease class, and an energy maintaining class based on an auditory perception model; and transferring energy of the energy decrease class of the far-end voice signal to the energy increase class.

6. The voice signal processing method of claim 1, wherein the changing of the far-end voice signal comprises changing the far-end voice signal based on a speaking pattern-based model.

7. The voice signal processing method of claim 1, wherein the anti-phase signal is generated based on the changed far-end voice signal of a previous frame.

8. A voice signal processing apparatus comprising:

at least one microphone configured to acquire a near-end noise signal and a near-end voice signal;

a receiver configured to acquire a far-end voice signal transmitted by a far-end terminal;

a controller configured to determine an output power of an anti-phase signal based on information about a frequency band of the near-end noise signal;

an articulation enhancer configured to determine a signal S1 that does not affect much on articulation improvement and a signal S2 that affects much on articulation improvement among a frequency band of the far-end voice signal, based on information about the frequency band of the far-end voice signal and a auditory perceptual model;

a noise reducer configured to generate the anti-phase signal of the near-end noise signal based on the output power of the anti-phase signal;

a voice signal changer configured to change the far-end voice signal by transferring an energy of a frequency band corresponding to the signal S1 to a frequency band corresponding to the signal S2, to reduce difference between the far-end voice signal including the near-end noise signal and the far-end voice signal; and an outputter configured to output a sum of the anti-phase signal and the changed far-end voice signal.

9. The voice signal processing apparatus of claim 8, wherein the anti- phase signal comprises an anti-phase signal with respect to a virtual noise signal estimated from the near-end noise signal based on at least one of a different between a position where the near-end noise signal is acquired and a position where the far-end voice signal is perceived or a difference between a time when the near-end noise signal is acquired and a time when the far-end voice signal is perceived.

10. The voice signal processing apparatus of claim 8, wherein the controller is further configured to:

determine the output power of the anti-phase signal based on at least one of information about encoding of the far-end voice signal and information about whether the far-end voice signal is being output.

11. The voice signal processing apparatus of claim 8, wherein the voice signal changer is further configured to reduce a difference between the acquired far-end voice signal and a far-end voice signal in an environment where the near-end noise signal and the anti-phase signal exist for each frequency band of a far-end voice signal spectrum.

12. A non-transitory computer-readable recording medium storing instructions that, when executed by a processor, cause the processor to:

acquire a near-end noise signal and a near-end voice signal by using at least one microphone;

acquire a far-end voice signal transmitted by a far-end terminal;

determine an output power of an anti-phase signal based on information about a frequency band of the near-end noise signal;

determine a signal S1 that does not affect much on articulation improvement and a signal S2 that affects much on articulation improvement among a frequency band of the far-end voice signal, based on information about the frequency band of the far-end voice signal and a auditory perceptual model;

generate the anti-phase signal of the near-end noise signal based on the output power of the anti-phase signal;

change the far-end voice signal transferring an energy of a frequency band corresponding to the signal S1 to a frequency band corresponding to the signal S2, to reduce difference between the far-end voice signal including the near-end noise signal and the far-end voice signal; and output a sum of the anti-phase signal and the changed far-end voice signal.

* * * * *